US009410757B2

(12) United States Patent
Miller, III

(10) Patent No.: US 9,410,757 B2
(45) Date of Patent: Aug. 9, 2016

(54) COILED COVER FOR FIREARM GAS TUBE

(71) Applicant: Spike's Tactical, LLC, Apopka, FL (US)

(72) Inventor: Thomas James Miller, III, Apopka, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 14/478,501

(22) Filed: Sep. 5, 2014

(65) Prior Publication Data

US 2016/0069626 A1 Mar. 10, 2016

(51) Int. Cl.

| | |
|---|---|
| ***F41A 15/00*** | (2006.01) |
| ***F41A 13/00*** | (2006.01) |
| ***F41A 5/28*** | (2006.01) |
| ***F41A 5/18*** | (2006.01) |

(52) U.S. Cl.

CPC . *F41A 13/00* (2013.01); *F41A 5/18* (2013.01); *F41A 5/28* (2013.01)

(58) Field of Classification Search

CPC ..... F41A 13/00; F41A 5/28; F41A 5/18
USPC ..... 42/90; 89/191.01, 193
See application file for complete search history.

(56) References Cited

U.S. PATENT DOCUMENTS

| | | | | | |
|---|---|---|---|---|---|
| 3,198,076 | A * | 8/1965 | Stoner | F41A 3/26 | 42/75.02 |
| 3,618,457 | A * | 11/1971 | Miller | F41A 5/18 | 89/1.4 |
| 4,765,224 | A * | 8/1988 | Morris | F41A 5/26 | 42/75.02 |
| 6,931,978 | B1 * | 8/2005 | Dionne | F41A 3/12 | 42/69.02 |
| 7,464,496 | B1 | 12/2008 | Davies et al. | | |
| 8,141,474 | B2 * | 3/2012 | Dublin | F41A 3/72 | 89/1.4 |
| 8,166,864 | B2 * | 5/2012 | Herring | F41A 5/18 | 89/191.02 |
| 8,261,653 | B2 * | 9/2012 | Crommett | F41A 5/28 | 89/191.01 |
| 8,584,575 | B2 * | 11/2013 | Crommett | F41A 5/28 | 89/191.01 |
| 8,661,963 | B2 * | 3/2014 | Patel | F41A 3/66 | 42/16 |
| 8,973,483 | B2 * | 3/2015 | Sullivan | 89/193 | |
| 9,038,525 | B2 * | 5/2015 | Sullivan | F16J 9/16 | 89/191.01 |
| 2011/0030260 | A1 * | 2/2011 | Herring | F41A 5/18 | 42/16 |
| 2011/0303082 | A1 * | 12/2011 | Hochstrate | F41A 3/66 | 89/193 |
| 2012/0079935 | A1 * | 4/2012 | Herring | F41A 5/18 | 89/193 |
| 2012/0137872 | A1 * | 6/2012 | Crommett | F41A 5/26 | 89/193 |
| 2012/0180648 | A1 * | 7/2012 | Sullivan | F16J 9/16 | 89/193 |
| 2012/0204713 | A1 * | 8/2012 | Patel | F41A 3/66 | 89/199 |
| 2013/0055883 | A1 * | 3/2013 | Cassels | F41A 5/28 | 89/193 |
| 2013/0276624 | A1 * | 10/2013 | Crommett | F41A 5/26 | 89/193 |

* cited by examiner

*Primary Examiner* — Michelle R Clement
(74) *Attorney, Agent, or Firm* — Wood Herron & Evans LLP

(57) ABSTRACT

A heat dissipating and strength enhancing cover for a firearm gas tube includes a wire helix formed of closely adjacent coils having an inner diameter sized to closely fit over and in contact with an exterior surface of a gas tube. The wire of the gas tube cover may be made of a Beryllium-Copper alloy and have sufficient flexibility to accommodate at least one bend in the gas tube. The ends of the gas tube cover may be formed to a substantially flat surface that is substantially perpendicular to a longitudinal axis of the helix and may include caps covering first and second ends of the gas tube cover. The caps may prevent rotation of the cover when installed. The cover may extend substantially between a gas block and means for mounting a barrel when installed.

6 Claims, 2 Drawing Sheets

COILED COVER FOR FIREARM GAS TUBE

FIELD OF INVENTION

This invention relates to gas operated firearm actions. More particularly, it relates to a flexible coiled cover for the gas tube that both enhances heat dissipation and increases its strength.

BACKGROUND OF THE INVENTION

In a gas operated automatic or semi-automatic firearm, propulsion gases are ported from the bore of the barrel, through a gas block, and into a gas tube, which carries the gases rearwardly for either direct impingement or gas piston operation to cycle the firearm's action. In the case of a typical AR15-type firearm, or the select-fire M16/M4 counterparts, the gas tube connects the gas block with the gas key on the bolt carrier for direct impingement cycling of the bolt carrier group. The burning propulsion gases carry a substantial amount of heat energy, some of which is transferred to the gas tube, which is typically made of stainless steel. When rounds are fired in a slow sequence, heat transferred to the gas tube will typically dissipate before reaching a level that could cause failure. However, rapid fire of one hundred or more rounds can result in a significant amount of heat being built up in the gas tube. If the temperature of the metallic gas tube exceeds a critical point, or after the firearm has been put through many cycles of overheating and cooling, the metal can become weakened and unable to contain the gas pressure. A "blowout" failure of the gas tube will render the firearm inoperable.

Various solutions have been proposed to address this problem, ranging from simply thickening the walls of the gas tube to adding fins or other structure that will increase heat dissipation from the gas tube. Each of these have a significant increase in cost, increased weight, or requiring a specially sized and shaped device to fit each of a wide range of gas tube shapes and lengths. Even in otherwise "identical" gas tubes, there is typically some variance in the required bend due to the method of manufacturing.

SUMMARY OF THE INVENTION

The present invention provides a coiled cover for the gas tube. The coil may be made from a tightly wound wire that fits snuggly over the gas tube. The coil can be wound in a straight configuration while allowing enough flex to accommodate the bend of a typical gas tube. The coil may be wound from a, for example, 0.080 inch diameter, wire. The wire may be a Beryllium-Copper alloy, which provides exceptional heat transfer along with retaining the required strength at high temperatures. The ends of the coil may be fixed or retained such that the diameter of the coil is maintained, reinforcing the pressure capacity of the gas tube.

Various other features, benefits, and aspects of the present invention will become apparent to a person of ordinary skill in the art upon considering the drawing and detailed description below.

BRIEF DESCRIPTION OF THE DRAWING

Like reference numerals are used to indicate like parts throughout the various figures of the drawing, wherein.

DETAILED DESCRIPTION OF THE INVENTION

Figure 1:
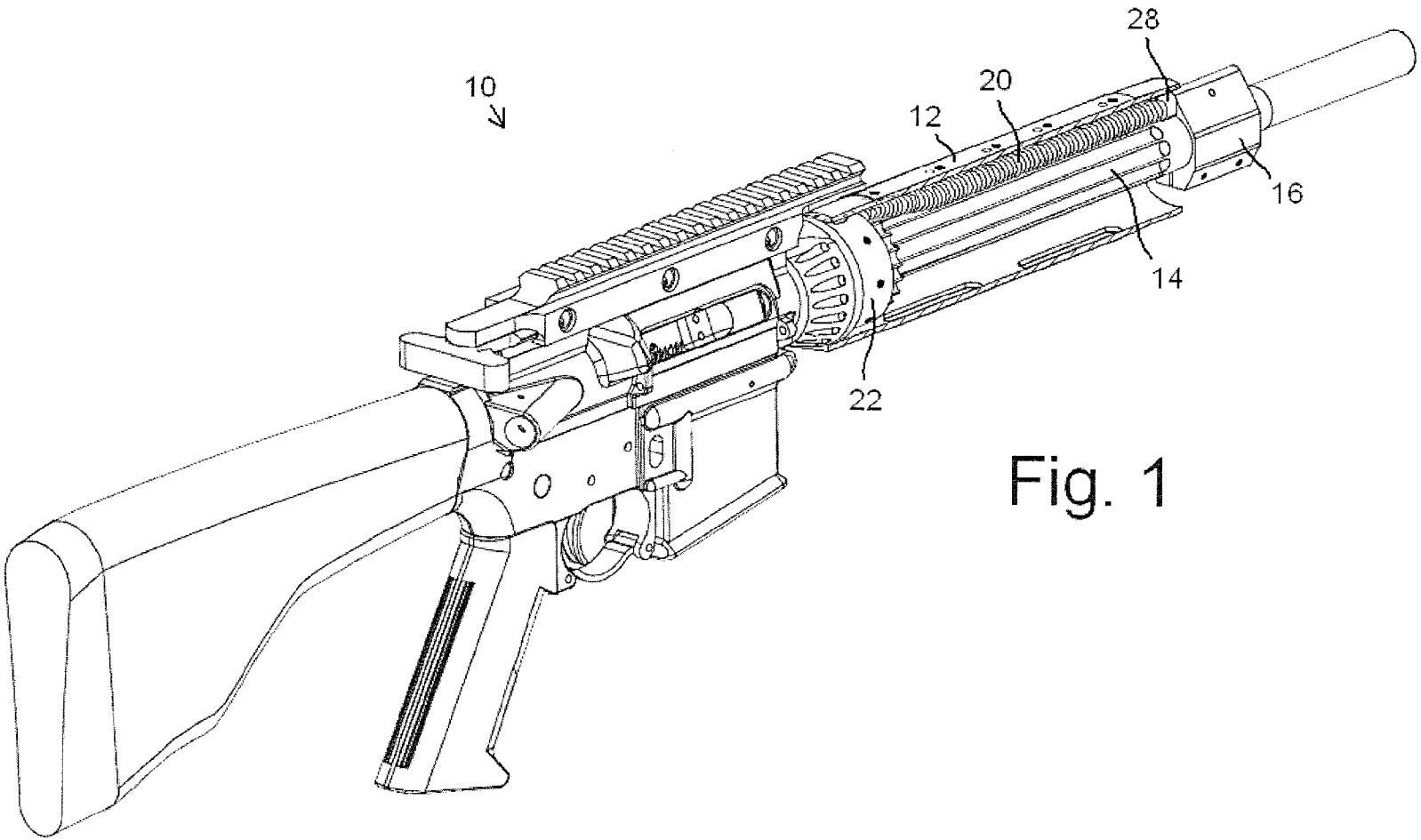
FIG. 1 is an isometric view of a rifle with the hand guard partially cut away to expose a coiled gas tube cover according to one embodiment of the present invention.
Figure 2:
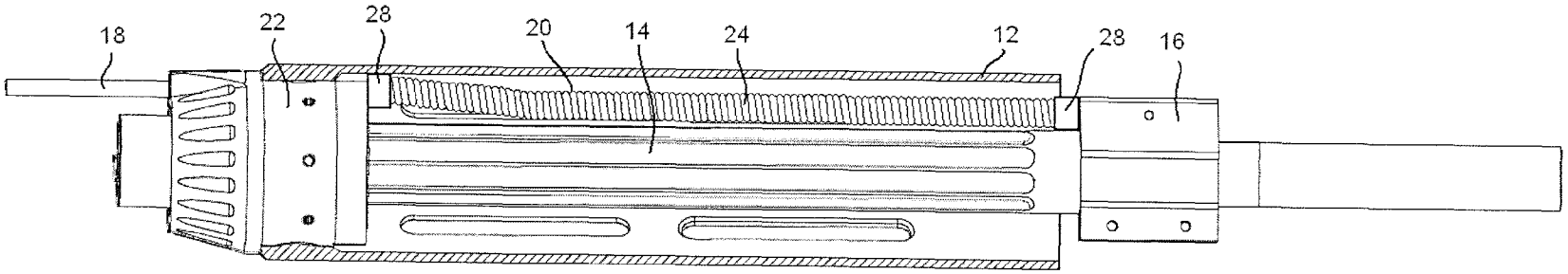
FIG. 2 is a side plan view of a barrel assembly with the hand guard cut away to show an installed position of the present invention.
Figure 3:
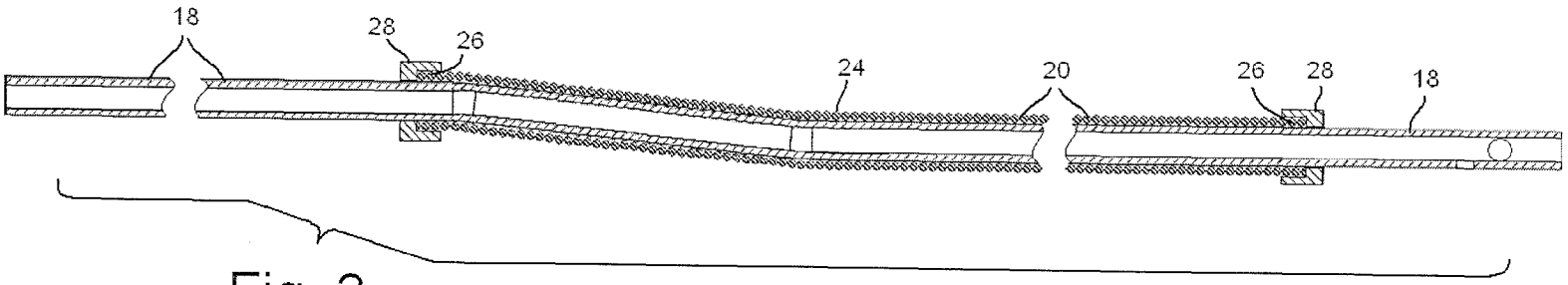
FIG. 3 is a longitudinal sectional view of a gas tube of indeterminate length shown with a coiled cover of the present invention installed thereon.

Referring to the various figures of the drawing, therein is shown at 10 a typical AR15-style rifle. This rifle is shown by way of example to illustrate the present invention, but the invention is not limited to use with any particular make, model, or style of gas operated firearm. The rifle can include a forearm or hand guard 12, which may act as a heat shield for the user or as a platform for mounting various accessories. The barrel 14 includes a gas block 16, at which propulsion gases are ported from the bore of the barrel 14 to a gas tube 18 according to well-known principles and construction.

The present invention provides a helically coiled cover 20 that may be fitted over the gas tube 18 between the gas block 16 and the means (barrel nut 22) for attaching the barrel 14 to the upper receiver or other action of the firearm. The coiled cover 20 may be made of a continuous length of closely wound wire to form a helix or coil 24 that closely fits over the exterior of a gas tube 18. According to one embodiment, the wire may be made of a Beryllium-Copper alloy. Other materials may be suitable, so long as they possess sufficient heat transfer qualities, strength at elevated temperatures, workability for formation into a coil, and reasonable cost.

End portions 26 of the coil 24 may be fixed and ground flat, substantially perpendicular to the length of the coil 24. End caps 28 may be provided to closely receive the end portions 26 into a socket for opening formed therein. The end caps 28 protect the end of the coil 24 and can be used to prevent twisting of the coil 24 once installed in the barrel assembly of a rifle 10. Attachment of the end caps 28 may be by press fit, threading, crimping, or any other suitable means.

The coiled cover 20 may be made in any desired length to accommodate variations in barrel length and position of the gas block 16 on the barrel 14. A coil 24 can be manufactured in standard lengths and then cut, as necessary, to fit a particular installation.

Accordingly, the coiled cover 20 may be installed at the time the rifle 10 is manufactured or may be retrofitted over an ordinary gas tube 18. The cost of manufacturing the coiled cover 20 is significantly lower than the cost of manufacturing alternative devices that include configurations of fins or the like and is more effective than making a gas tube 18 with heavier side walls.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A heat dissipating and strength enhancing cover for a firearm gas tube, comprising a wire helix formed of coils always in direct contact with each adjacent coil and having an inner diameter sized to closely fit over and in direct contact with an exterior surface of a gas tube when installed on the gas tube.

2. The gas tube cover of claim 1, wherein the wire is made of a Beryllium-Copper alloy.

3. The gas tube cover of claim 1, wherein the helix has sufficient flexibility to accommodate at least one bend in the gas tube.

4. The gas tube cover of claim 1, wherein the ends of the cover are formed to a substantially flat surface substantially perpendicular to a longitudinal axis of the helix.

5. The gas tube cover of claim 1, further comprising caps covering first and second ends of the cover.

6. The gas tube cover of claim 1, wherein the cover extends substantially between a gas block and means for mounting a barrel when installed.

* * * * *